US007656368B2

(12) United States Patent
Lee et al.

(10) Patent No.: US 7,656,368 B2
(45) Date of Patent: Feb. 2, 2010

(54) DISPLAY DEVICE AND DRIVING METHOD

(75) Inventors: Myung-Ho Lee, Suwon-si (KR); Seong-Ho Baik, Gwacheon-si (KR); In-Hwan Kim, Seoul (KR); Seung-Chan Byun, Incheon (KR)

(73) Assignee: LG Display Co., Ltd., Seoul (KR)

( * ) Notice: Subject to any disclaimer, the term of this patent is extended or adjusted under 35 U.S.C. 154(b) by 585 days.

(21) Appl. No.: 11/477,955

(22) Filed: Jun. 29, 2006

(65) Prior Publication Data

US 2007/0001938 A1 Jan. 4, 2007

(30) Foreign Application Priority Data

Jun. 30, 2005 (KR) ..... 10-2005-0057485

(51) Int. Cl.
*G09G 3/30* (2006.01)

(52) U.S. Cl. ..... 345/76; 345/92

(58) Field of Classification Search ..... 345/76, 345/92

See application file for complete search history.

(56) References Cited

U.S. PATENT DOCUMENTS

| | | | | |
|---|---|---|---|---|
| 6,762,735 | B2 * | 7/2004 | Koyama | 345/76 |
| 6,791,129 | B2 * | 9/2004 | Inukai | 257/208 |
| 6,909,409 | B2 * | 6/2005 | Tanada | 345/51 |
| 2001/0015715 | A1 * | 8/2001 | Hebiguchi et al. | 345/92 |
| 2001/0028481 | A1 | 10/2001 | Waechter et al. | |
| 2002/0149553 | A1 * | 10/2002 | Tsujimura et al. | 345/92 |
| 2003/0030609 | A1 * | 2/2003 | Lee | 345/87 |
| 2003/0189559 | A1 | 10/2003 | Lee et al. | |
| 2003/0193490 | A1 * | 10/2003 | Liu et al. | 345/204 |
| 2004/0056828 | A1 * | 3/2004 | Choi et al. | 345/82 |
| 2005/0062692 | A1 * | 3/2005 | Lo et al. | 345/76 |
| 2006/0227081 | A1 * | 10/2006 | Joo et al. | 345/76 |

FOREIGN PATENT DOCUMENTS

| | | |
|---|---|---|
| CN | 1276590 | 12/2000 |
| CN | 1435805 | 8/2003 |
| CN | 1457220 A | 11/2003 |
| JP | 2001-343911 | 12/2001 |
| JP | 2002-032037 | 1/2002 |
| JP | 2002-040963 | 2/2002 |
| JP | 2002-040990 | 2/2002 |

(Continued)

OTHER PUBLICATIONS

Office Action issued in corresponding Chinese Patent Application No. 2006100871760; issued Feb. 29, 2008.
Office Action issued in corresponding Chinese Patent Application No. 2006100871760; issued Aug. 15, 2008.

(Continued)

*Primary Examiner*—Amare Mengistu
*Assistant Examiner*—Koosha Sharifi
(74) *Attorney, Agent, or Firm*—Brinks Hofer Gilson & Lione

(57) ABSTRACT

A display device includes a data line; first and second gate lines; a first pixel including a first switching element, the first switching element connected to the data line and the first gate line; and a second pixel including a second switching element, the second switching element connected to the data line and the first and second gate lines.

9 Claims, 5 Drawing Sheets

FOREIGN PATENT DOCUMENTS

| | | | |
|---|---|---|---|
| JP | 2002-050484 | | 2/2002 |
| JP | 2004-004590 | | 1/2004 |
| JP | 2005-157266 | | 6/2005 |
| WO | 01/06484 | A1 | 1/2001 |

OTHER PUBLICATIONS

Office Action dated Aug. 30, 2006 for corresponding Korean Patent Application No. 10-2005-0057485.

Office Action issued in corresponding Japanese Patent Application No. 2006-154220; mailed Jul. 27, 2009.

* cited by examiner

DISPLAY DEVICE AND DRIVING METHOD

The present application claims the benefit of priority to Korean Patent Application No. 2005-057485, filed on Jun. 30, 2005, which is hereby incorporated by reference as if fully set forth herein.

TECHNICAL FIELD

The present application relates to a display device, and more particularly, to an organic electroluminescent display (OELD) device and a method of driving an OELD device.

BACKGROUND

Display devices have employed cathode-ray tubes (CRT) to display images. However, various types of flat panel displays, such as liquid crystal display (LCD) devices, plasma display panel (PDP) devices, field emission display (FED) devices, and electro-luminescent display (ELD) devices, are currently being developed as substitutes for the CRT. Among these various types of flat panel displays, LCD devices have advantages of thin profile and low power consumption, but have disadvantages of using a backlight unit because they are non-luminescent display devices. However, as organic electroluminescent display (OELD) devices are self-luminescent display devices, they are operated at low voltages and have a thin profile. Further, the OELD devices have advantages of fast response time, high brightness and wide viewing angles.

As shown in FIG. 1, a pixel of the related art OELD device is connected to a gate line S, a data line D and a power line VDD. The pixel includes a switching thin film transistor N1, a driving thin film transistor N2, a capacitor C and a organic light emitting diode OLED.

A gate electrode of the switching thin film transistor N1 is connected to the gate line S, and a source electrode of the switching thin film transistor N1 is connected to the data line D. One electrode of the capacitor C is connected to the drain electrode of the switching thin film transistor N1, and the other electrode of the capacitor C is connected to a ground terminal (GND). A drain electrode of the driving thin film transistor N2 is connected to a cathode of the organic emitting diode OLED, a gate electrode of the driving thin film transistor N2 is connected to the drain electrode of the switching thin film transistor N1, and a source electrode of the driving thin film transistor N2 is connected to the ground terminal (GND).

FIG. 2 is a waveform view of a gate signal, a data signal and a power signal applied to the pixel of FIG. 1.A gate signal having a high or low level VGH or VGL is applied to the switching thin film transistor N1 through the gate line S. When the high level VGH is applied, the switching thin film transistor N1 is turned on. When the switching thin film transistor N1 is turned on, a data signal is stored in the capacitor C and the driving thin film transistor N2 is turned on. Accordingly, a current flows on the driving thin film transistor N2 and the organic emitting diode OLED emits light. The stored data signal determines an amount of a current flowing on the driving thin film transistor N2, and the amount of the current determines light intensity of the organic emitting diode OLED.

When the related art OELD device is used as a high resolution display device, the number of signal lines and driving ICs needed increases. When the OELD device is used as a high resolution and small size display device, installation space of the components required maybe insufficient.

SUMMARY

A display device is disclosed including a data line; first and second gate lines; a first pixel including a first switching element, the first switching element connected to the data line and the first gate line; and a second pixel including a second switching element, the second switching element connected to the data line and the first and second gate lines.

In another aspect, a method of driving a display device includes turning on a first switching element of a first pixel in first and second times of a horizontal time interval, and a second switching element of a second pixel in the first time; and supplying first and second data signals in the first and second times, respectively, to a data line connected to the first and second pixels.

In another aspect, a method of driving a display device includes supplying first and second data signals in first and second times of a horizontal time interval, respectively; and storing the first and second data signals to a first pixel in the first and second times, respectively, and the first data signal to a second pixel in the first time.

DETAILED DESCRIPTION

Figure 1:
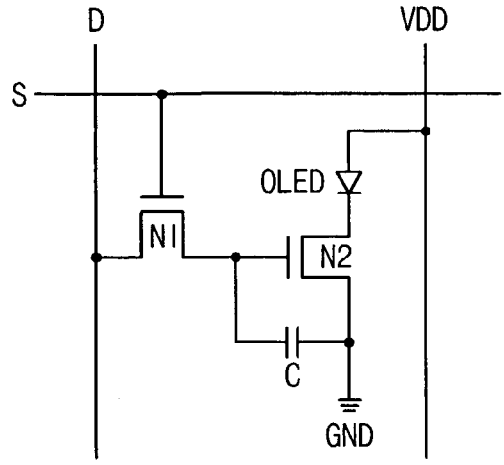
FIG. 1 RELATED ART
FIG. 1 is a circuit diagram of an OELD device according to the related art.
Figure 2:
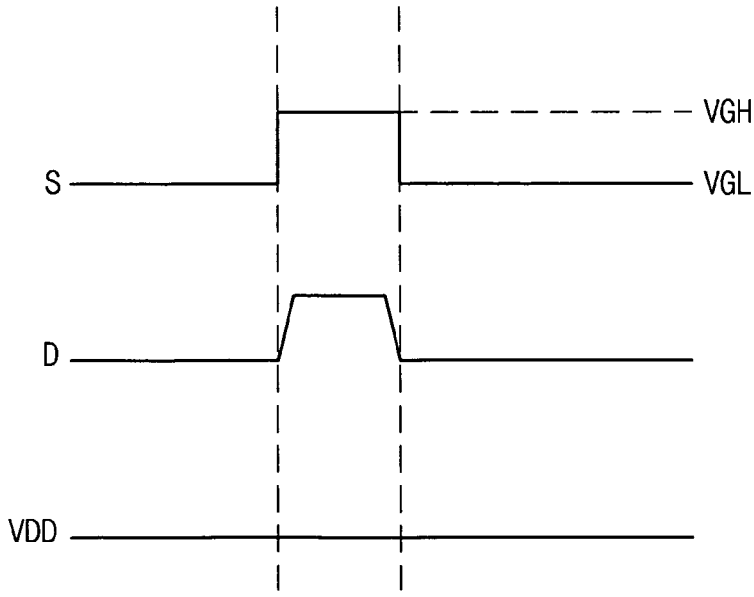
FIG. 2 RELATED ART
FIG. 2 is a waveform view of a gate signal, a data signal and a power signal applied to the pixel of FIG. 1.
Figure 3:
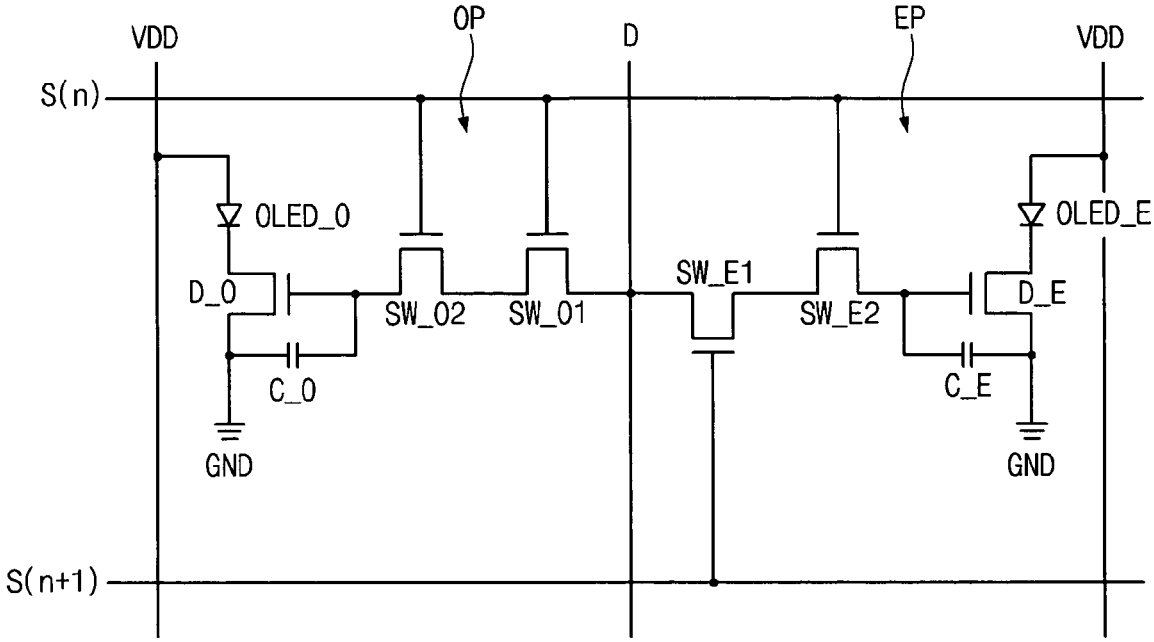
FIG. 3 is a circuit diagram of an OELD device according to an exemplary embodiment.

Exemplary embodiments may be better understood with reference to the drawings, but these examples are not intended to be of a limiting nature. Like numbered elements in the same or different drawings perform equivalent functions. When a specific feature, structure, or characteristic is described in connection with an embodiment, it will be understood that one skilled in the art may effect such feature, structure, or characteristic in connection with other embodiments, whether or not explicitly stated herein FIG. 3, shows a partial circuit diagram of an organic light emitting diode (OELD) device in a first example Two pixels, OP and EP, are disposed in columns on opposing sides of a data line D, and are each connected to the same data line D. A pixel OP at a left side of the data line D is referred to as an odd pixel OP, and a pixel EP at a right side of the data line D is referred to as an even pixel EP. The odd and even pixels OP and EP thus share the same data line D, and the odd and even pixels OP and EP are applied with the same data signals. The odd and even pixels OP and EP are supplied with the power through a power line VDD.

Although the odd and even pixels OP and EP are connected to the same data line D, the odd and even pixels OP and EP have different connections to gate lines S(n) and S(n+1). The odd pixel OP is connected to the $n^{th}$ gate line S(n), and the even pixel EP is connected to both the $(n+1)^{th}$ and $n^{th}$ gate lines S(n) and S(n+1).

The odd pixel OP thus includes an odd switching element, an odd driving element, an odd capacitor C_O, and an odd organic light emitting diode OLED_O. The odd switching element includes first and second odd switching thin film transistors SW_O1 and SW_O2 connected in series. The first and second odd switching thin film transistors SW_O1 and SW_O2 are connected to the $n^{th}$ gate line S(n). The first odd switching thin film transistor SW_O1 is also connected to the data line D.

The odd driving element includes an odd driving thin film transistor D_O. A gate electrode of the odd driving thin film transistor D_O is connected to a drain electrode of the second odd switching thin film transistor SW_O2.

The odd capacitor C_O is connected to the gate and source electrodes of the odd driving thin film transistor D_O. The odd light emitting diode OLED_O is connected to the power line VDD and the drain electrode of the odd driving thin film transistor D_O.

The odd switching element is turned on or off in accordance that the $n^{th}$ gate line S(n) is applied with ON or OFF (high or low) gate signal, since the first and second odd switching thin film transistors SW_O1 and SW_O2 are connected to the same $n^{th}$ gate line S(n).

When the odd switching element is turned on, a data signal on the data line D passes through the odd switching element. Then, the data signal is stored in the odd capacitor C_O and is applied to the odd driving element. When the odd driving thin film transistor D_O is supplied with the data signal, the odd driving thin film transistor D_O is turned on. When the odd driving thin film transistor D_O is turned on, a current flows on the odd driving thin film transistor D_O and the odd organic light emitting diode OLED_O emits light. The data signal stored in the odd capacitor C_O determines an amount of the current flowing on the odd driving thin film transistor D_O, and the amount of the current determines light intensity emitted from the odd organic light emitting diode OLED_O.

The even pixel EP includes an even switching element, an even driving element, an even capacitor C_E, and an even organic light emitting diode OLED_E. The even switching element includes first and second even switching thin film transistors SW_E1 and SW_E2 connected in series. The first and second even switching thin film transistors SW_E1 and SW_E2 are connected to the $(n+1)^{th}$ and $n^{th}$ gate lines S(n+1) and S(n), respectively. The first even switching thin film transistor SW_E1 is connected to the data line D. The first and second even switching thin film transistors SW_E1 and SW_E2 may be connected to the $n^{th}$ and $(n+1)^{th}$ gate lines S(n) and S(n+1), respectively.

The even driving element includes an even driving thin film transistor D_E. A gate electrode of the even driving thin film transistor D_E is connected to a drain electrode of the second even switching thin film transistor SW_E2.

The even capacitor C_E is connected to the gate and source electrodes of the even driving thin film transistor D_E. The even organic light emitting diode OLED_E is connected to the power line VDD and the drain electrode of the even driving thin film transistor D_E.

The even switching element is turned on when both the $(n+1)^{th}$ and $n^{th}$ gate lines S(n+1) and S(n) are applied with an ON gate signal simultaneously, and otherwise, the even switching element is turned off. This occurs since the first and second even switching thin film transistors SW_E1 and SW_E2 are connected to the different gate lines S(n+1) and S(n).

When the even switching element is turned on, a data signal on the data line D passes through the even switching element. Then, the data signal is stored in the even capacitor C_E and is applied to the even driving element. When the even driving thin film transistor D_E is supplied with the data signal, the even driving thin film transistor D_E is turned on. When the even driving thin film transistor D_E is turned on, a current flows on the even driving thin film transistor D_E and the even organic light emitting diode OLED_E emits light. The data signal stored in the even capacitor C_E determines an amount of the current flowing on the even driving thin film transistor D_E, and the amount of the current determines light intensity emitted from the even organic light emitting diode OLED_E.

Figure 4:
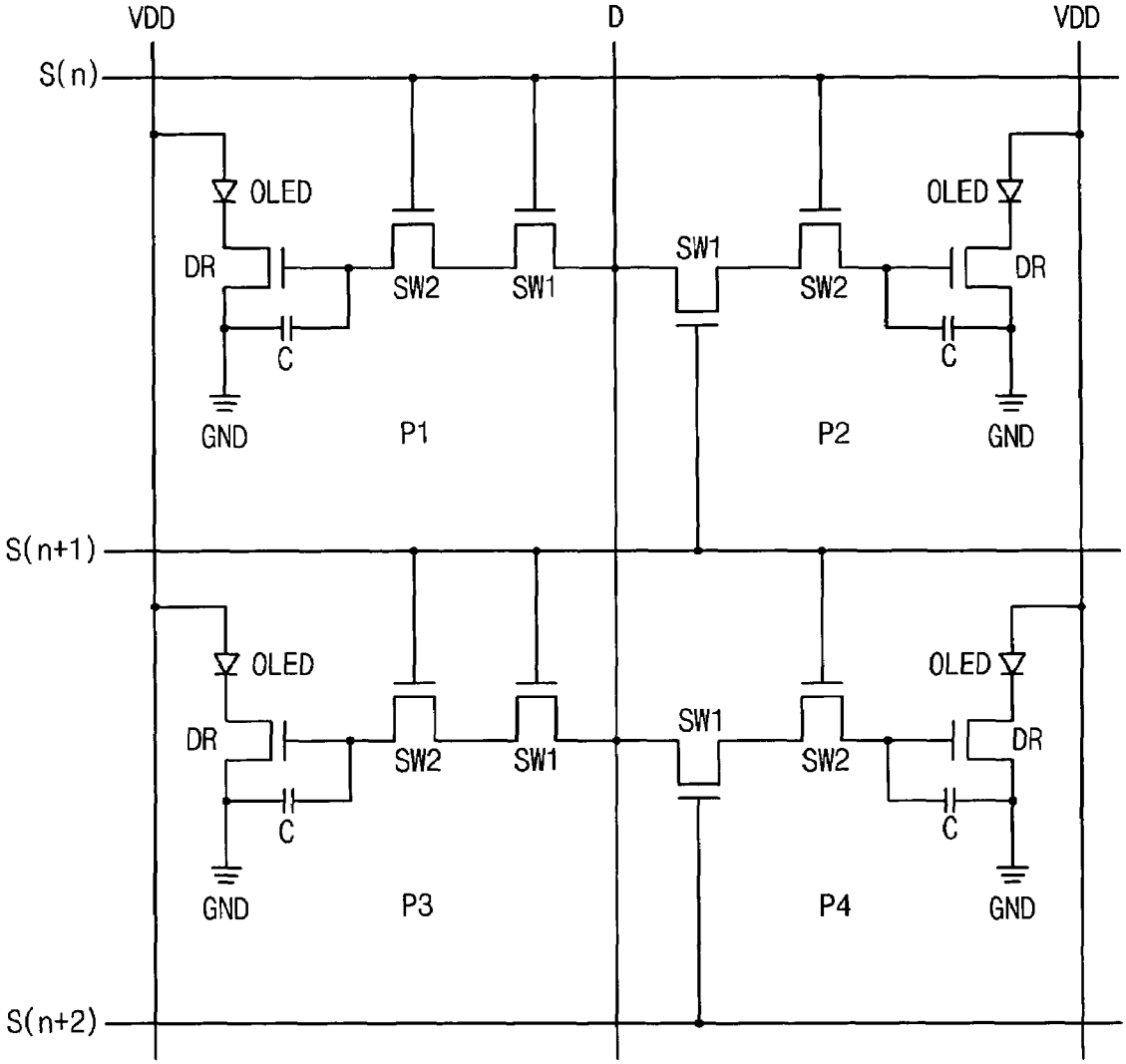
FIG. 4 is a circuit diagram illustrating a method of driving an OELD device according to the exemplary embodiment.
Figure 5:
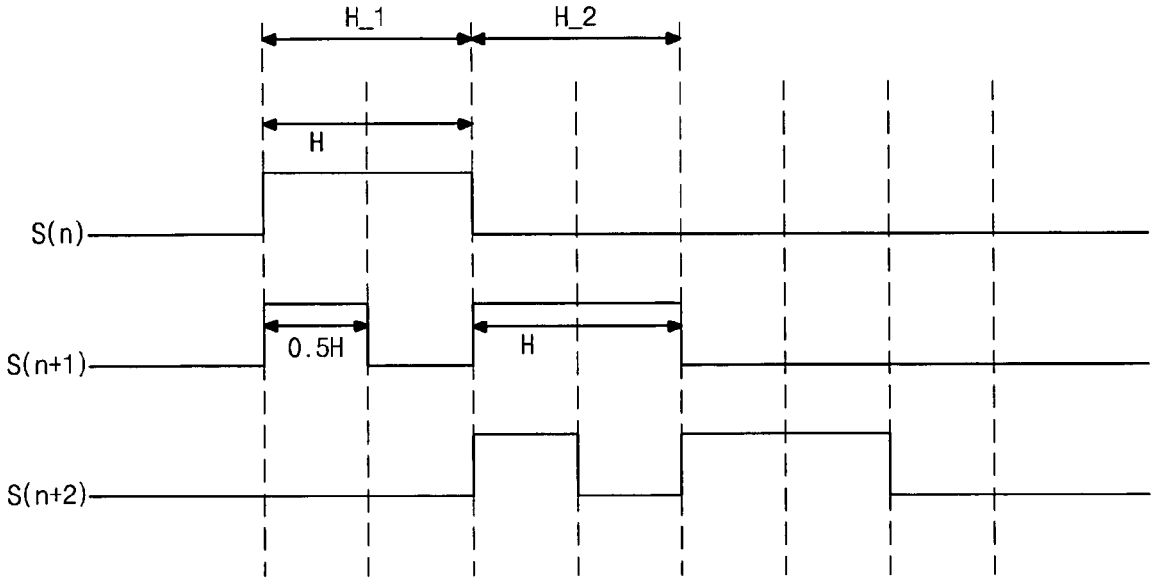
FIG. 5 is a waveform view of gate signals to drive the OELD device of FIG. 4.

FIG. 4 is a circuit diagram illustrating a method of driving an OELD device, and FIG. 5 is a waveform view of gate signals to drive the OELD device of FIG. 4.

In FIG. 4, the left two pixels (P1, P3) correspond to the odd pixel of FIG. 3 and the right two pixels (P2,P4) correspond to the even pixel of FIG. 3., Corresponding components in each of the pixels have the same reference designations. Each of first to fourth pixels P1 to P4 includes first and second switching thin film transistors SW1 and SW2, a driving thin film transistor DR, a capacitor C, and an organic light emitting diode OLED.

Gate signals having ON and OFF (high and low) levels are sequentially supplied to $n^{th}$ to $(n+2)^{th}$ gate lines S(n) to S(n+2). The gate signals are sequentially supplied to $n^{th}$ to $(n+2)^{th}$ gate lines S(n) to S(n+2) with a delay time of one horizontal time interval H. The horizontal time interval H is the time where data signals are supplied to pixels in one row line. The gate signal has two ON levels. That is, the gate signal has a first ON level for a first half of a horizontal time interval (H/2), an OFF level for a second half of the horizontal time interval, and a second ON level for a next horizontal time interval. Therefore, adjacent gate lines have the ON level simultaneously for a half horizontal time interval (H/2). The second half of the horizontal time interval H may have the first ON level, and the first half of the horizontal time interval H may have the OFF level.

In a first half of a first horizontal time interval H_1, the $n^{th}$ and $(n+1)^{th}$ gate lines S(n) and S(n+1) is supplied with the ON gate signal, and a first data signal is supplied to the data line D. The first and second switching thin film transistors SW_1 and SW_2 of the first and second pixels P1 and P2 are turned on. The first data signal is applied to both the first and second pixels P1 and P2 and stored in the capacitors C of the first and second pixels P1 and P2.

In a second half of the first horizontal time interval H_1, the $n^{th}$ gate line S(n) is still supplied with the ON gate signal, the $(n+1)^{th}$ gate line S(n+1) is supplied with the OFF gate signal, and a second data signal is supplied to the data line D. The first switching thin film transistor SW_1 of the second pixel P2 is turned off, and the second pixel P2 stores the first data signal. The first and second thin film transistors SW_1 and SW_2 of the first pixel P1 are still turned on, and the first pixel P1 stores the second data signal instead of the first data signal.

As explained above, the $n^{th}$ gate line S(n) has the ON gate signal for the first horizontal time interval H_1, and the $(n+1)^{th}$ gate line S(n+1) has the ON gate signal for the first half of the first horizontal time interval H_1. The first data signal is supplied for the first half of the first horizontal time interval H_1, and the second data signal is supplied for the second half of the first horizontal time interval H_1. A switching element of the first pixel P1 is turned on for the first horizontal time interval, and thus the first pixel P1 stores the first data signal for the first half and the second data signal for the second half finally instead of the first data signal. A switching element of the second pixel P2 is turned on for the first half and turned off for the second half, and thus the second pixel P2 stores the first data signal.

In a first half of a second horizontal time interval H_2, the $(n+1)^{th}$ and $(n+2)^{th}$ gate lines S(n+1) and S(n+2) is supplied with the ON gate signal, and the third data signal is supplied to the data line D. The first and second switching thin film transistors SW_1 and SW_2 of the third and fourth pixels P3 and P4 are turned on. The third data signal is applied to both the third and fourth pixels P3 and P4 and stored in the capacitors C of the third and fourth pixels P3 and P4. The third pixel P3 previously stored the first data signal for the first half of the first horizontal time interval H_1, but the third pixel P3 stores the third data signal instead of the first data signal in the first half of the second horizontal time interval H_2.

In a second half of the second horizontal time interval H_2, the $(n+1)^{th}$ gate line S(n+1) is still supplied with the ON gate signal, the $(n+2)^{th}$ gate line S(n+2) is supplied with the OFF gate signal, and a fourth data signal is supplied to the data line D. The first switching thin film transistor SW_1 of the fourth pixel P4 is turned off, and the fourth pixel P4 stores the third data signal. The first and second thin film transistors SW_1 and SW_2 of the third pixel P3 are still turned on, and the third pixel P3 stores the fourth data signal instead of the third data signal.

As explained above, the $(n+1)^{th}$ gate line S(n+1) has the ON gate signal for the second horizontal time interval H_2, and the $(n+2)^{th}$ gate line S(n+2) has the ON gate signal for the first half of the second horizontal time interval H_2. The third data signal is supplied for the first half of the second horizontal time interval H_2, and the fourth data signal is supplied for the second half of the second horizontal time interval H_2. A switching element of the third pixel P3 is turned on for the first horizontal time interval, and thus the third pixel P3 stores the third data signal for the first half and the fourth data signal for the second half replacing of the third data signal. A switching element of the fourth pixel P4 is turned on for the first half and turned off for the second half, and thus the fourth pixel P4 stores the third data signal.

As a result, the first to fourth pixels P1 to P4 have the desired data signals. The driving thin film transistors of the first to fourth pixels P1 to P4 are turned on in accordance with the stored data signals, and the light emitting diode OLED of the first to fourth pixels P1 to P4 emit light in corresponding to the stored data signals.

Figure 6:
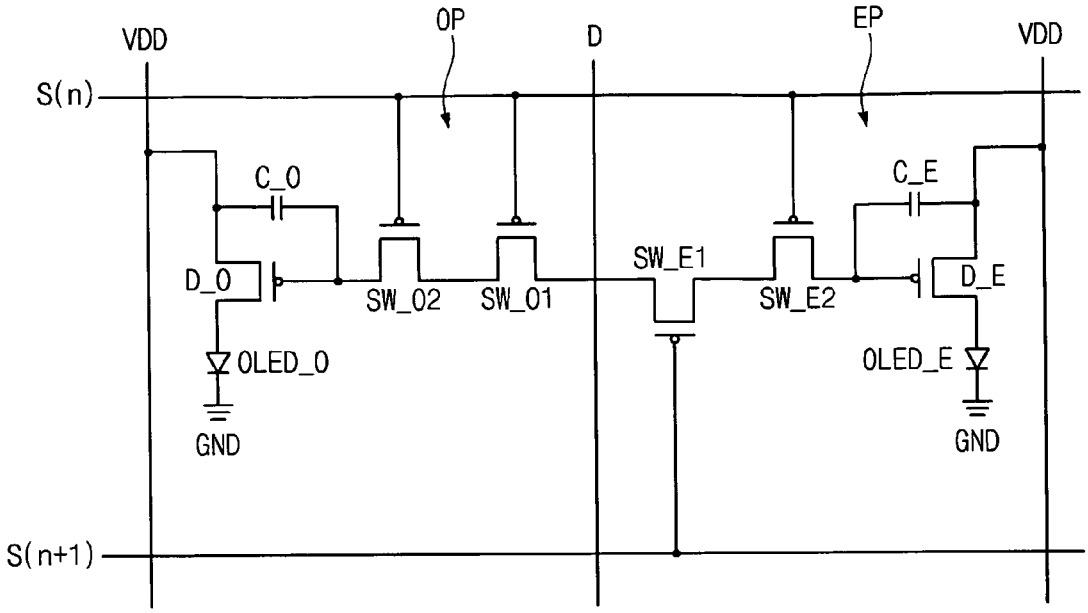
FIG. 6 is a circuit diagram of an OELD device according to another exemplary embodiment.
Figure 7:
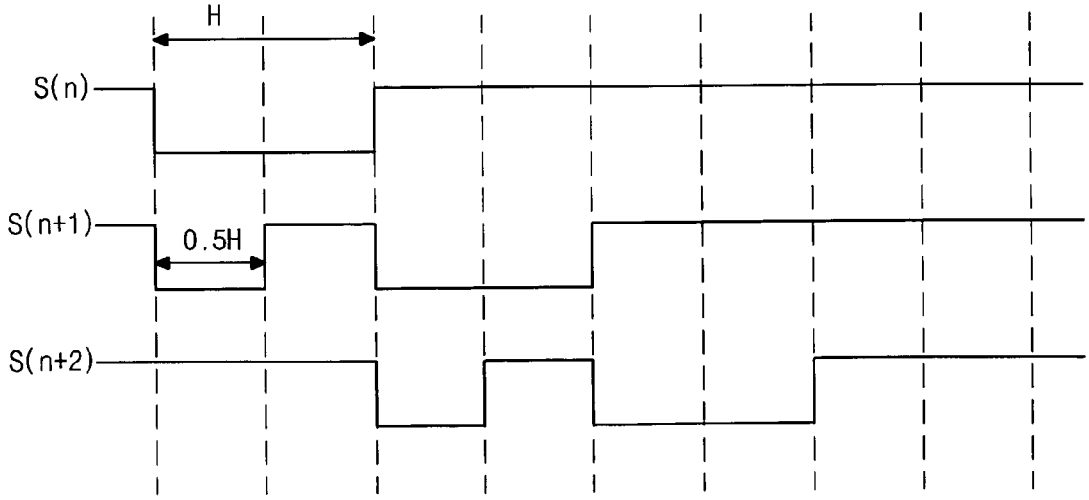
FIG. 7 is a waveform view of gate signals to drive the OELD device of FIG. 6.

FIG. 6 is a circuit diagram of an OELD device according to another example of the present invention, and FIG. 7 is a waveform view of gate signals to drive the OELD device of FIG. 6.

Odd and even pixels OP and EP of FIG. 6 are similar to the odd and even pixels of FIG. 3 except for switching and driving thin film transistors. An n-type thin film transistor is used for the switching and driving thin film transistors of FIG. 3, but a p-type thin film transistor is used for the switching and driving thin film transistors SW_O1, SW_O2, SW_E1, SW_E2, D_O and D_E. Since the p-type thin film transistor is used for the pixels OP and EP, the positions of capacitors C_O and C_E and light emitting diodes OLED_O and OLED_E are different from those of FIG. 3. The capacitor C_O and C_E is connected to a power line VDD and the gate electrode of the driving thin film transistor D_O and D_E. The light emitting diode OLED_O and OLED_E is connected to a ground terminal GND and the driving thin film transistor D_O and D_E.

Since the p-type thin film transistor is used, the thin film transistors are turned on by a low gate signal as an ON gate signal. Accordingly, a gate signal waveform of FIG. 7 is inverted with respect to that of FIG. 5.

The OELD device of FIG. 6 is similar to that of FIG. 3, except for a type of the thin film transistor, and thus the OELD device of FIG. 6 is driven in a manner similar to that of FIG. 3. Accordingly, explanations of a method of driving the OELD device of FIG. 6 are omitted.

In the examples described, pixels in columns adjacent to both sides of the data line share the same data line. One of two pixels on the same row sharing the same data line is connected to a gate line, and the other is connected to the gate line and a next gate line. For one horizontal time interval, two different data signals are supplied to the data line, and thus the one pixel has one data signal and the other pixel has the other data signal. In this respect, it will be appreciated by a person of skill in the art that the odd and even configurations of pixels may be interchanged and the data signal stored in each pixel may be altered by changing the sequence in which the data signals are applied to the data line.

Accordingly, a number of the data lines may be reduced by half in comparison with a number of the data lines in the related art, and a number of driving ICs is also reduced.

The apparatus and method may also be used to drive other display devices such as a liquid crystal display (LCD) or a plasma display panel (PDP).

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A display device, comprising:

a data line;

first and second gate lines;

a first pixel including at least one first switching element, the at least one first switching element connected to the data line and the first gate line, wherein the at least one first switching element includes first and second thin film transistors in series; and a second pixel including at least one second switching element, the at least one second switching element connected to the data line and the first and second gate lines, wherein the at least one second switching element includes third and fourth thin film transistors in series and connected to the first and second gate lines, respectively, wherein a first ON gate signal is supplied to the first, second and third thin film transistors in first and second times of a horizontal time interval to turn on the first, second and third thin film transistors, and wherein a second ON gate signal is supplied to the fourth thin film transistor in the first time to turn on the fourth thin film transistor.

2. The device according to claim 1, wherein the first pixel further includes a thin film transistor connected to the at least one first switching element, a display element connected to the thin film transistor, and a capacitor connected to the thin film transistor.

3. The device according to claim 2, wherein the display element is one of a organic light emitting diode (OLED), liquid crystal element or plasma display element.

4. The device according to claim 1, wherein the second pixel further includes a thin film transistor connected to the at least one second switching element, an light organic emitting diode connected to the thin film transistor, and a capacitor connected to the thin film transistor.

5. A method of driving a display device, comprising:

turning on at least one first switching element of a first pixel in first and second times of a horizontal time interval, and turning on at least one second switching element of a second pixel in the first time; and supplying first and second data signals in the first and second times, respectively, to a data line connected to the first and second pixels, wherein turning on the at least one first and second switching elements includes:

supplying a first ON gate signal to first and second thin film transistors of the at least one first switching element and to a third thin film transistor of the at least one second switching element, in the first and second times; and supplying a second ON gate signal to a fourth thin film transistor of the at least one second switching element in the first time, wherein the first and second thin film transistors are in series, and the third and fourth thin film transistors are in series.

6. The method according to claim 5, wherein the first time and the second time are sequential.

7. The method according to claim 6, wherein each of the first and second times is one half of the horizontal time interval.

8. The method according to claim 5, wherein the first pixel includes a fifth thin film transistor connected to the at least one first switching element, an organic light emitting diode connected to the fifth thin film transistor, and a capacitor connected to the fifth thin film transistor.

9. The method according to claim 5, wherein the second pixel includes a sixth thin film transistor connected to the at least one second switching element, an organic light emitting diode connected to the sixth thin film transistor, and a capacitor connected to the sixth thin film transistor.

* * * * *

UNITED STATES PATENT AND TRADEMARK OFFICE

CERTIFICATE OF CORRECTION

PATENT NO. : 7,656,368 B2
APPLICATION NO. : 11/477955
DATED : February 2, 2010
INVENTOR(S) : Lee et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 803 days.

Signed and Sealed this

Twenty-eighth Day of December, 2010

David J. Kappos

David J. Kappos
*Director of the United States Patent and Trademark Office*